US006286283B1

(12) United States Patent
Kessler

(10) Patent No.: US 6,286,283 B1
(45) Date of Patent: Sep. 11, 2001

(54) MODULAR STRUCTURAL SYSTEM

(76) Inventor: Steve Kessler, 28 N. Stonington Rd., S. Laguna, CA (US) 92677

( * ) Notice: Subject to any disclaimer, the term of this patent is extended or adjusted under 35 U.S.C. 154(b) by 0 days.

(21) Appl. No.: 08/754,523

(22) Filed: Nov. 21, 1996

(51) Int. Cl.[7] ..... E04B 1/19; E04B 1/38; A63H 33/08

(52) U.S. Cl. ..... 52/655.1; 52/656.9; 52/81.3; 407/170; 407/217; 446/126

(58) Field of Search ..... 446/126, 127; 403/170, 171, 217; 52/655.1, 81.3, 656.9, DIG. 10

(56) References Cited

U.S. PATENT DOCUMENTS

| | | | | |
|---|---|---|---|---|
| 856,838 | * | 6/1907 | Bell et al. | 52/DIG. 10 X |
| 2,936,530 | * | 5/1960 | Bowen | 446/126 X |
| 3,600,825 | | 8/1971 | Pearce . | |
| 3,688,461 | * | 9/1972 | Rensch | 52/655.1 X |
| 3,877,138 | * | 4/1975 | Suchowski | 52/656.9 X |
| 4,078,328 | * | 3/1978 | Rayment | 446/126 X |
| 4,247,218 | * | 1/1981 | Jeannin | 52/81.3 X |
| 4,432,661 | * | 2/1984 | Phillips et al. | 52/81.3 X |
| 4,449,843 | * | 5/1984 | Wendle | 52/81.3 X |
| 4,610,561 | * | 9/1986 | Cecchellero et al. | 52/655.1 X |
| 4,637,180 | | 1/1987 | Zeigler . | |
| 4,838,003 | * | 6/1989 | Zeigler | 403/171 X |
| 5,061,219 | | 10/1991 | Glickman . | |
| 5,097,645 | | 3/1992 | Sanderson . | |
| 5,137,486 | | 8/1992 | Glickman . | |
| 5,145,441 | | 9/1992 | Hsun . | |
| 5,199,919 | | 4/1993 | Glickman . | |
| 5,238,438 | | 8/1993 | Glickman . | |
| 5,282,767 | | 2/1994 | Gelardi . | |
| 5,318,470 | * | 6/1994 | Denny | 446/126 |
| 5,368,514 | | 11/1994 | Glickman et al. . | |
| 5,431,211 | * | 7/1995 | Guillemet | 52/656.9 X |
| 5,556,219 | * | 9/1996 | Mason | 403/171 X |

FOREIGN PATENT DOCUMENTS

| | | | | |
|---|---|---|---|---|
| 801441 | * | 1/1951 | (DE) | 446/126 |

* cited by examiner

*Primary Examiner*—Robert Canfield
(74) *Attorney, Agent, or Firm*—Stetina Brunda Garred & Brucker

(57) ABSTRACT

A modular structural system for building structural models or for constructing actual structures. The system includes at least one connector hub member comprising a plurality of projections arranged in a plurality of planes each for engaging an end of a strut member, with all projections having cross sectional geometries identical with cross sectional geometries of attached strut members at sites of respective attachment. Second, the system includes at least one strut member having a first end and a second end, with each end having an engageable portion for engagement with a projection of the connector hub member. The strut member has a strut cross-sectional geometry identical to and in alignment with the cross-sectional geometry of a projection and adjacent protuberances of the hub member when the strut member is engaged with the projection. Such cross-sectional geometry can be chosen as desired or required for any particular application, with the singular requirement being that cross-sectional strut geometry and cross sectional hub geometry are the same at the site interface. Retention members are included for securing the respective ends of the strut members with the projections of the connector hub members. The strut members can have along their respective exposed surfaces flanges or the like capable of accepting and retaining panels or other finishing construction material.

24 Claims, 5 Drawing Sheets

Fig. 1
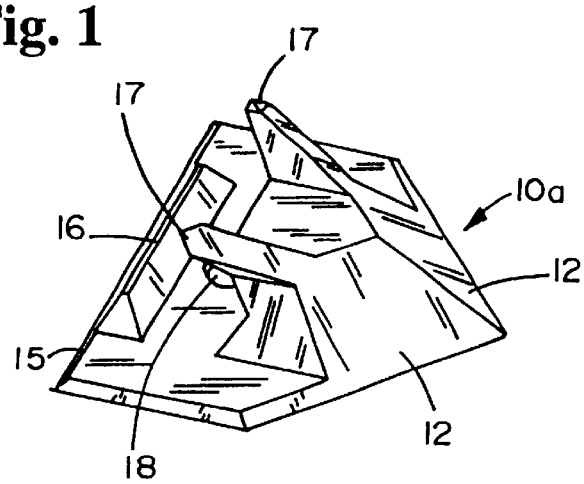
Fig. 2
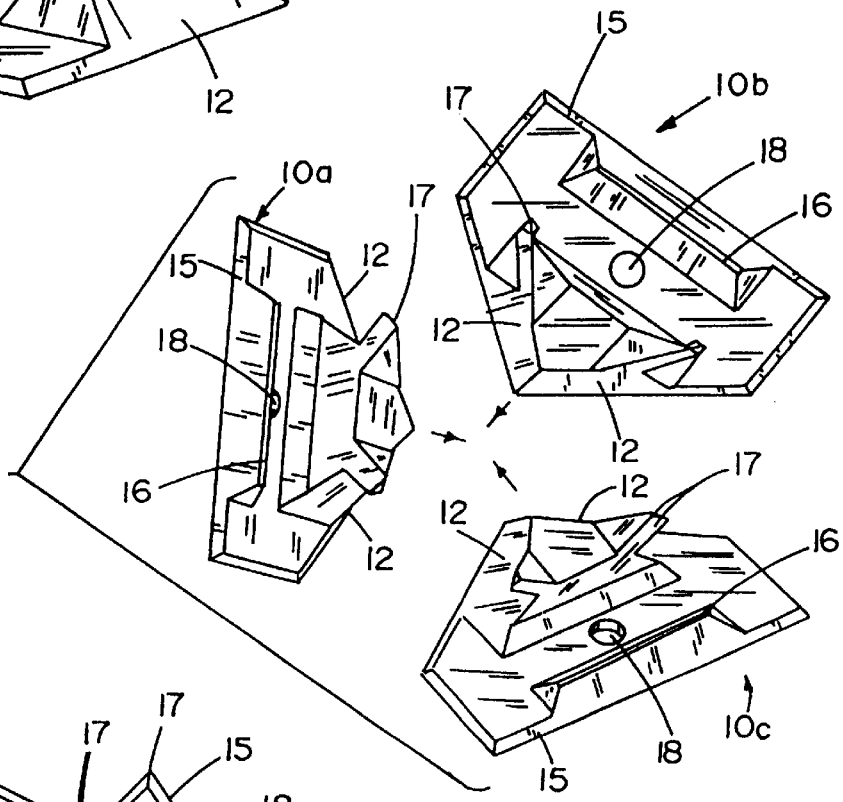
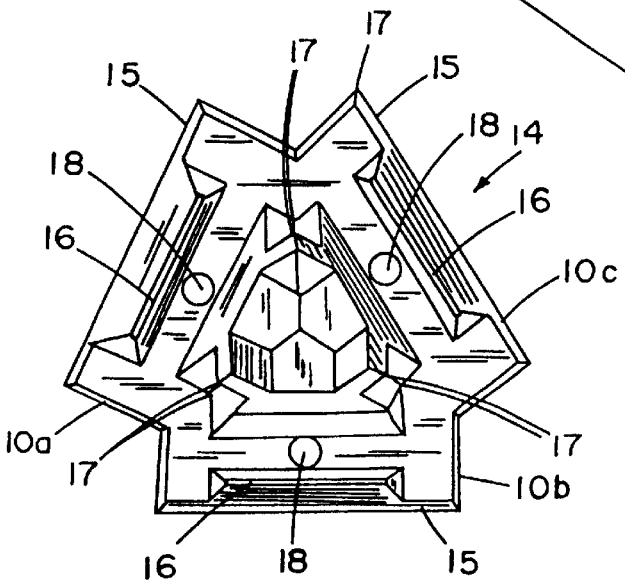
Fig. 3

MODULAR STRUCTURAL SYSTEM

FIELD OF THE INVENTION

This invention relates in general to modular structural systems, and in particular to a modular structural system embodying connector hub members having a plurality of projections with adjacent protuberances radiating from a common site, with each projection for engaging an end of a strut member and arranged in a plurality of planes, and cooperating strut members with cross sections identical to those of the respective projections with their adjacent protuberances, and engageable end portions for engagement with the projections of the connector hub members, whereby the structural system can be employed in constructing structural models or in building actual structures including those utilized in fluid conveyance.

BACKGROUND OF THE INVENTION

Many times the design of a structure includes acute and oblique angularity coupled with cross sectional uniformity of structurally significant portions which consequently require complimentary structural systems to maintain stable construction integrity. In particular, a plurality of course directions from a single hub site can be desired, with such directions exemplified by strut structures, that may or may not function as anchor sites for panels or the like, to project from the hub site through a number of planes to thereafter terminate at an end site or to engage with yet another hub site from which additional strut structures project. Not only may a real-life structure require such angularity and cross sectional uniformity, but also does any model of a structure that is constructed as an aid or guide in studying or otherwise observing or displaying this structure. Also, besides construction considerations, hollow struts could be employed as fluid conduits for fluid traveling from a central hub location to a remote location, with passageways of the hub being registrable with complimentary passageways through the struts. Additionally, and beyond actual building construction, the design and assembly of structural models, whether for subsequent actual building design, for researching design feasibilities and appearances, or simply for amusement, require flexibility and variety in choices of structural presentation.

Since prior art structural systems lack significant options for structural design choices, it is apparent that a need is present for a modular structural system wherein a wide variety of representations of designs as well as actual designs can be readily provided. Accordingly, a primary object of the present invention is to provide a modular structural system employing connector hub members having a plurality of strut member engagement components arranged in a plurality of planes such that choices of strut member assignment and direction can be numerous while cross sectional configurations of engagement components and strut members are identical at sites of respective interfaces.

Another object of the present invention is to provide a modular structural system wherein such strut members and connector hub members can be weight bearing in a building construction or they can function as fluid conduits with registrable passageways such that fluids can be conveyed within an assembled system.

Still another object of the present invention is to provide a modular structural system wherein the strut members can function as anchor sites for panels and the like in finished construction.

Yet another object of the present invention is to provide a modular structural system wherein strut members and connector hub members are sized to enable the construction of models for experimentation in structural as well as aesthetic design.

These and other objects of the present invention will become apparent throughout the description of the invention which now follows.

SUMMARY OF THE INVENTION

The present invention is a modular structural system for building structural models or for constructing actual structures. The system comprises, first of all, at least one connector hub member comprising a plurality of projections arranged in a plurality of planes each for engaging an end of a strut member, with all projections having cross sectional geometries identical with cross sectional geometries of attached strut member at sites of respective attachments. Second, the system comprises at least one strut member having a first end and a second end, with each end comprising an engageable portion for engagement with a projection of the connector hub member. The strut member has a strut cross-sectional geometry identical to and in alignment with the cross-sectional geometry of a projection and adjacent protuberances of the hub member when the strut member is engaged with the projection. Such cross-sectional geometry can be chosen as desired or required for any particular application, with the singular requirement being that cross-sectional strut geometry and cross sectional hub geometry are the same at the site of interface. Retention members are included for securing the respective ends of the strut members with the projections of the connector hub members. One preferable securement is that wherein each projection of the connector hub member and each slidingly engageable portion of the strut member have apertures that register with each other upon engagement of the projection and the engageable portion with each other, with the retention member being a pin placeable within the registered apertures. Of course, other retention means, such as would be non-limitedly exemplified through a detente favorably situated along respective engagement surfaces of a hub member and a strut member, can accomplish such retention. The strut members can have along their respective exposed surfaces flanges of the like capable of accepting and retaining panels or other finishing construction material.

The hub member can be of one piece molded construction, for example, or, as in one preferred embodiment, the hub member is constructed from a plurality of geometrically identical units bonded to each other to form the plurality of identical projections and protuberances. Specifically, each such geometrical unit of the connector hub member comprises a plurality of identical geometrical components bonded to each other wherein two such units form a cross section of the projection and adjacent protuberances, wherein the projection engages the end of one strut member. Because each geometrical unit has at least one surface area, preferably a generally planar surface area, that is complimentary to at least one surface area of another geometrical unit, a bonding site is thereby provided for bonding respective units together and forming the particular cross section. Various units can be chosen to construct various cross sectional geometries as desired to thereby be identical at respective sites of engagement with cross sectional geometries of chosen strut members engageable with the connector hub members as described above.

As is apparent, the present invention provides a modular structural system employing connector hub members having a plurality of strut member engagement projections arranged in a plurality of planes that provide a plurality of cooperating identical cross sectional geometries at sites of engagement, thereby affording a myriad of choices of strut member assignment and direction, whether for construction, fluid transmission, model making, or amusement. The external geometries of the strut members smoothly blend into the matching geometries of the connector hub members to thereby eliminate any interference with each other as a construction is being formed. When such external geometry of the strut members includes flanges that blend into an identical geometry of a connector hub member at sites of engagement, these flanges can readily be employed as anchor sites for accepting panels or the like in providing construction designs.

BRIEF DESCRIPTION OF THE DRAWINGS

An illustrative and presently preferred embodiment of the invention is shown in the accompanying drawings in which:

FIG. 1 is a perspective view of a geometrical component for constructing a geometrical unit of a connector hub member;

FIG. 2 is a perspective view illustrating assembly of three components illustrated in FIG. 1;

FIG. 3 is a perspective view of a geometrical unit formed from the assembly illustrated in FIG. 2;

DETAILED DESCRIPTION OF THE PREFERRED EMBODIMENT

Figure 4:
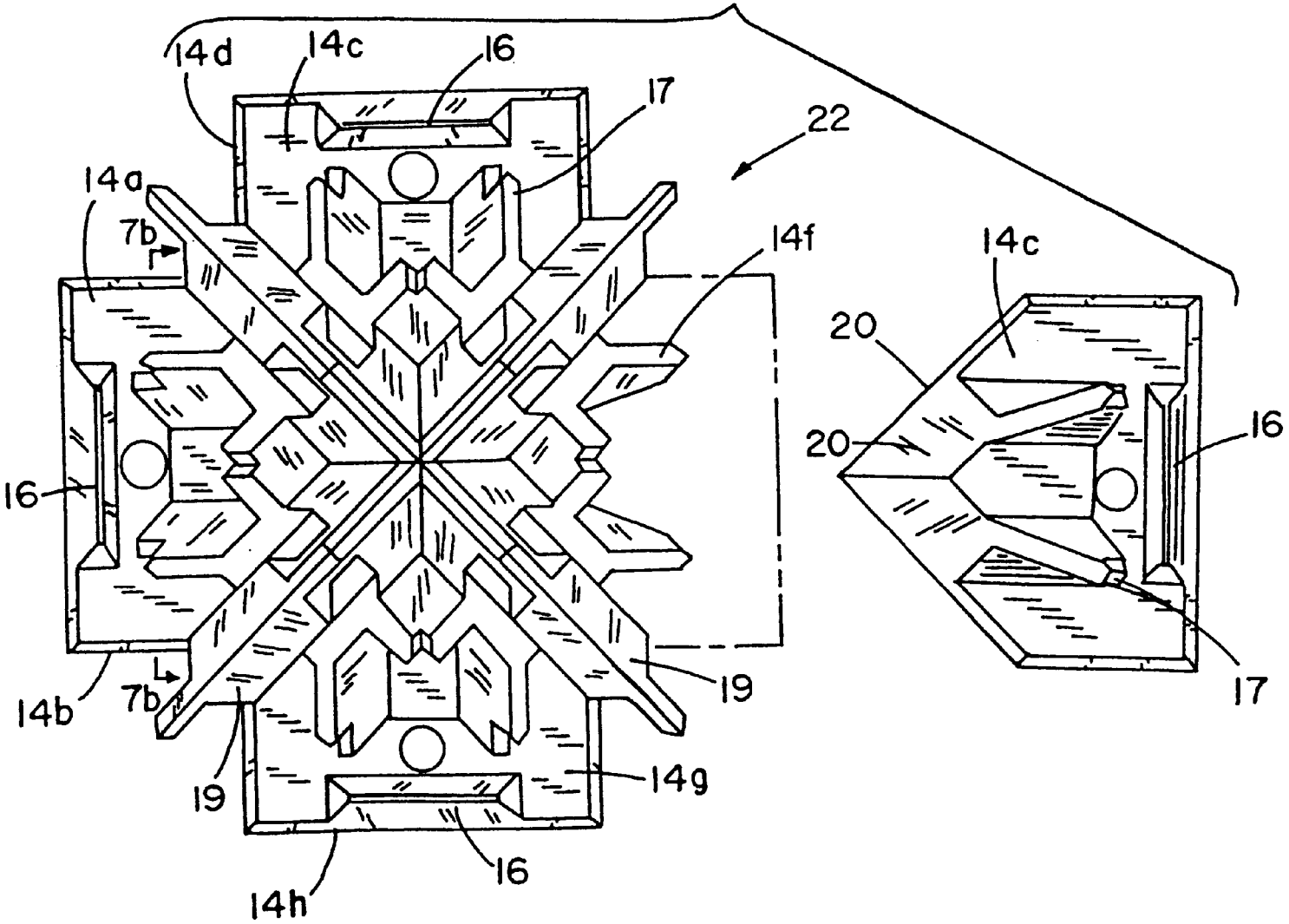
FIG. 4 is a plan view of a connector hub member with one geometrical component broken away.

Referring to FIGS. 1–3, three identical geometrical components 10*a,* 10*b,* 10*c,* each having planar surface areas 12, are assembled as illustrated in FIG. 2 by being permanently bonded as with adhesive to each other along adjacent planar surface areas 12 to form a geometrical unit 14 shown in FIG. 3. While individual components are joined to each other to form the unit 14, it is to be understood that such a unit can also be of one-piece molded construction. Near the outer edge 15 of each component 10*a,* 10*b,* 10*c* is a flange 16 and an aperture 18 disposed interiorly from the flange 16 while symmetrically positioned opposing protuberances 17 project upwardly and outwardly.

In order to construct a non-molded connector hub member, a plurality of units 14 are joined to each other to thereby form a plurality of identical projections in a plurality of planes for engaging respective ends of strut members. The units 14 are joined such that two flanges 16 are in back-to-back alignment and project outwardly to create a flange 16 on each side of two joined units 14 thereby forming a projection 19 while respective apertures 18 are in registration with each other. FIG. 4 shows eight units 14*a,* 14*b,* 14*c,* 14*d,* 14*e,* 14*f,* 14*g,* 14*h* bonded with adhesive to each other along generally planar complimentary surface areas 20 to form a connector hub member 22. Specifically, unit 14*a* has bonded thereto and immediately behind it identical unit 14*b*. Likewise, units 14*c* and 14*d,* units 14*e* and 14*f,* and units 14*g* and 14*h* are respectively bonded to each other, as are all laterally adjacent units bonded to each other (e.g. units 14*a* and 14*c;* units 14*b* and 14*d*). Once again, while units are bonded to each other to form a hub member, it is to be understood that hub members can also be of one-piece molded construction. Twelve projections 19 thus are formed by 12 respective pairs of back-to-back aligned flanges 16 as earlier described.

Figure 6:
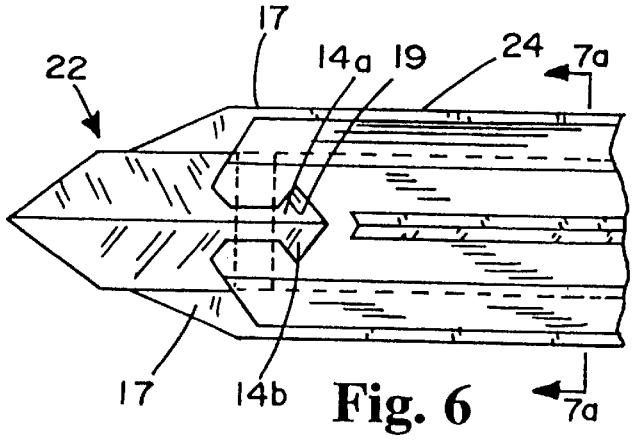
FIG. 6 is a partial side elevation view of a strut member engaged with a projection of a connector hub member.
Figure 5:
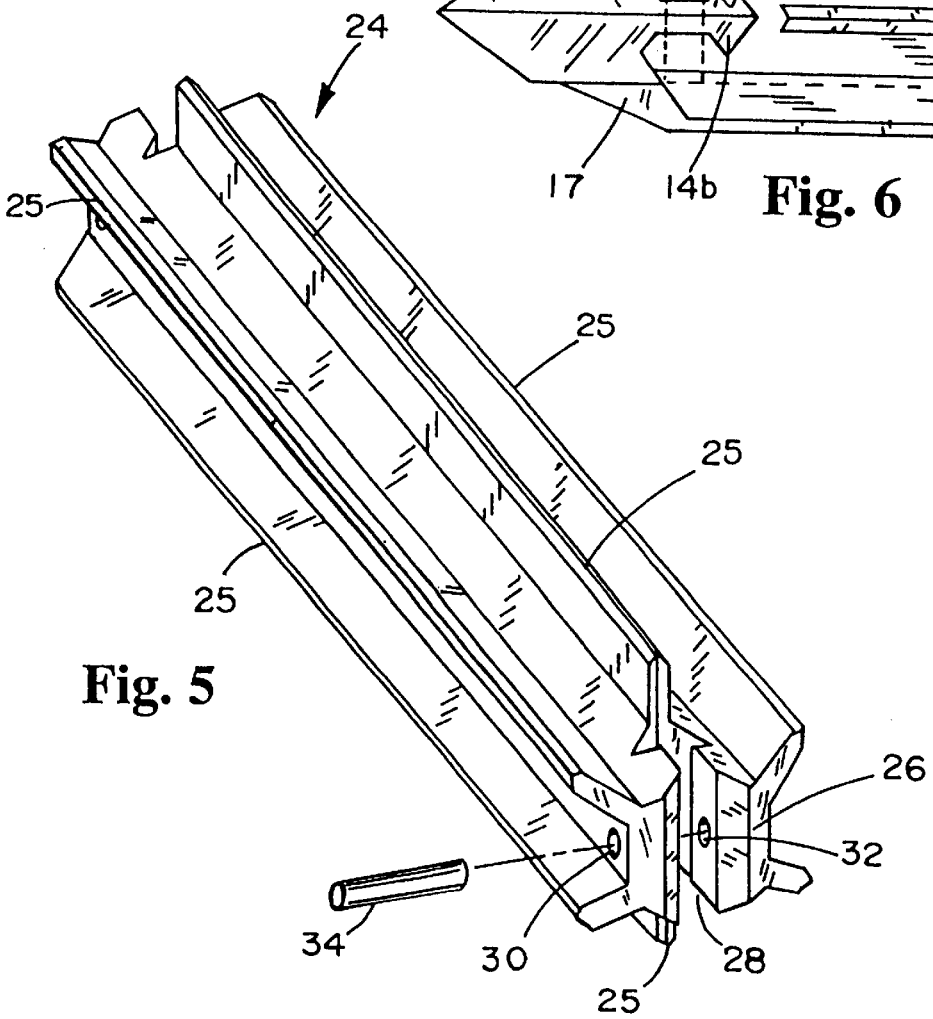
FIG. 5 is a perspective view of a strut member.
Figure 7A:
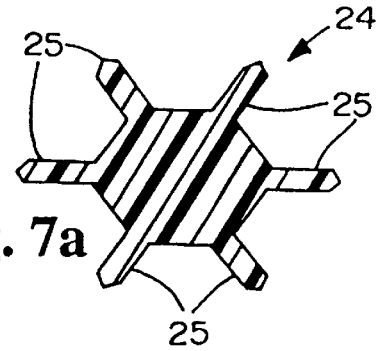
FIG. 7*a* is a section view of the strut member along line 7*a*—7*a* of FIG. 5.
Figure 7B:
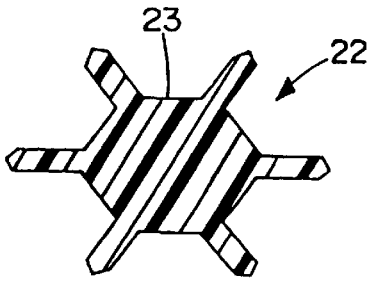
FIG. 7*b* is a section view along line 7*b*—7*b* of FIG. 4.

FIGS. 5 and 7*a* show a strut member 24 having strut flanges 25 along its exterior surface and having at each end thereof an open jaw structure 26 forming a channel 28 and having aligned apertures 30, 32. The channel 28 can slidingly engage a projection 19 and be retained in place with a pin 34 disposed within the apertures, 30, 18, 32. FIG. 6 shows such securement, with aligned flanges 16 of units 14*a* and 14*b* of connector hub member 22 forming a projection 19 disposed within the channel 28 and there retained with the pin 34 in place through the apertures 30, 18, 32. Cross-section geometry of the strut 24 as shown in FIG. 7*a* is identical to cross-section geometry of the projection 19 along with interfacing protuberances 17 shown in FIG. 7*b* of the connector hub member 22 as it would be in alignment with a strut 24 connected thereto. Specifically, the connector hub member 22 shown in FIG. 4 is a 12-way connector member capable of engaging twelve strut members 24, with direction possibilities defined in a Cartesian coordinate system where positive X is to the right, positive Y is toward the top of the drawing sheet, and positive Z comes from the sheet toward the viewer. The twelve possibilities, where the first number is an angle in the XY plane and the second number is an angle from the XY plane in Z, are as follows: (1) 0°, 0°; (2) 90°, 0°; (3) 180°, 0°; (4) 270°, 0°; (5) 45°, 45°; (6) 135°, 45°; (7) 225°, 45°; (8) 315°, 45°; (9) 45°, −45°; (10) 135°, −45°; (11) 225°, −45°; and (12) 315°, −45°.

Figure 7C:
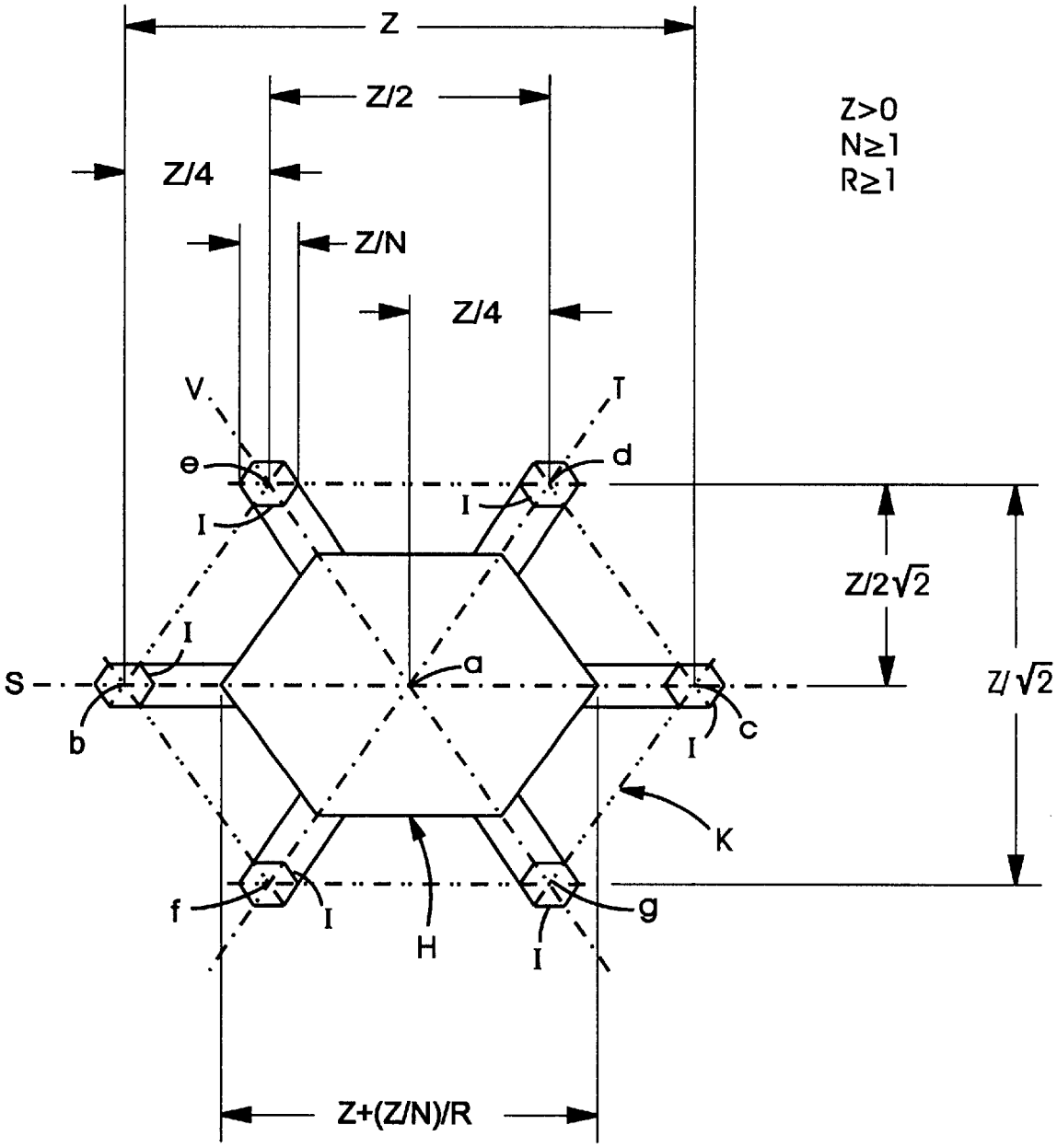
FIG. 7*c* illustrates a mathematical relationship among the strut flanges and a hub member projection with adjacent protuberances.

FIG. 7*c* illustrates the spatial relationship of the flanges 25 of the preferred embodiment as well as the spatial relationship of a hub member projection 19 and adjacent protuberances 17, and takes into account specific cross sectional and size relationships depending upon construction requirements. Specifically, the preferred embodiment is formed uniformly along respective axes as described below. Thus, axis S includes points a, b and c, with points b and c equidistant from point a. The distance between points b and c is Z where Z is greater than zero.

Axis T is defined by points a, d and f, where point d has a horizontal distance of Z/4 from point a and a vertical distance $Z/2\sqrt{2}$ from point a. Point f has a vertical distance $Z/\sqrt{2}$ from point d and a horizontal distance Z/2 from point d. Mirrored about axis S are points d and f that have counterparts point g and point e respectively, with axis V defined by points g and e.

As shown in phantom in FIG. 7*c,* polygon K is thus formed by points b, e, d, c, g, and f, with an overall horizontal dimension of Z. Each of the outer portions of the six flanges of the preferred embodiment are defined by polygon I formed uniformly about points b, e, d, c, g, and f similarly as polygon K is formed about point a. Polygon I has an overall horizontal dimension of Z/N where N is equal to or greater than one. Similarly, the exposed sides of the central core of the preferred embodiment are defined by polygon H formed uniformly about point a. Polygon H has an overall horizontal dimension of Z+(Z/N)/R, where R is equal to or greater than one. As is thus apparent, polygons I and H define actual external configurations that are spatially completed in accord with dimensioning as shown in the phantom lines of FIG. 7*c*.

Figure 8:
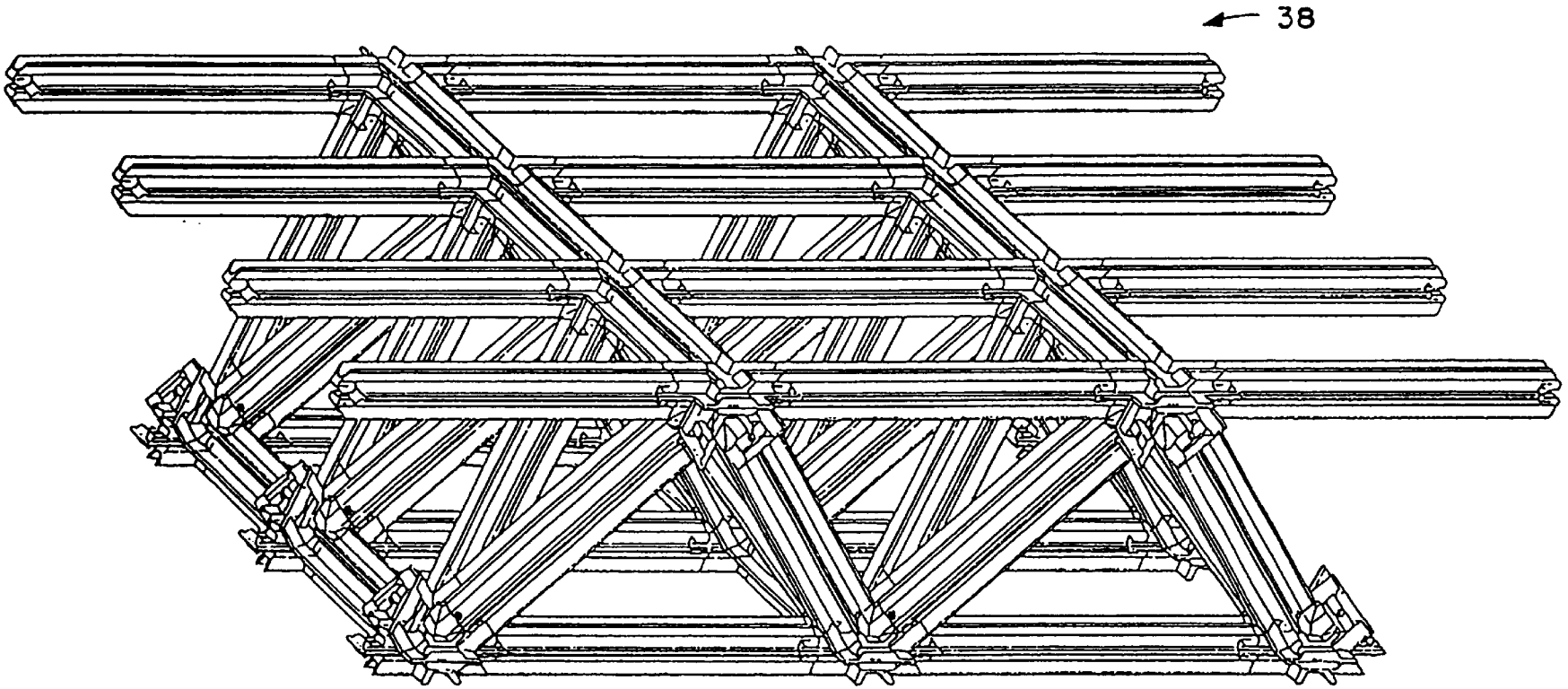
FIG. 8 is a perspective view of a modular structure.

Because both the strut flanges 25 and hub member projections 19 with respective adjacent protuberances 17 cross sectionally follow the above mathematical pattern, both strut and connector geometries are identical for both structural integrity and utility of strut member and connector hub member in indoor and outdoor building construction, model making, and the like. Cross sectional geometries can be chosen as desired as long as strut and connector geometries are alike to thereby eliminate any interference with each other as a construction is being formed utilizing smooth transitions from strut members to connector hubs. Thus, while the preferred embodiment shows a connector hub member 22 capable of accepting 12 struts members 24, other hub members of differing geometries can be constructed to accept fewer strut members having complimentary cross sectional geometries. The modular structure 38 of FIG. 8 is included to exemplify diversity of construction while providing identical cross sectional geometries of strut members and connector member projections with adjacent protuberances that are in-line with each other. For a fluid-transmission embodiment of the modular structural system, as non-limitedly exemplified in the delivery of utility products such as gas, water, etc., the connector hub members and the strut members can be provided with passageways therethrough registrable with each other to thereby permit such fluid passage and its delivery to a remote site.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A modular structural system comprising:

a) at least one connector hub member comprising a plurality of projections with adjacent protuberances arranged in a plurality of planes with each projection for engaging an end of a strut member, and with all respective projections with adjacent protuberances having identical cross sectional geometries;

b) at least one strut member having a first end and a second end, with each end comprising an engageable portion for engagement with a projection of the connector hub member, said strut member having a strut cross-sectional geometry identical to and in alignment with the cross-sectional geometry of a projection when the strut member is engaged with the projection; and c) a retention member for securing the end of the strut member with the projection of the connector hub member.

2. A modular structural system as claimed in claim 1 wherein each projection of the connector hub member and each engageable portion of the strut member have apertures that register with each other upon engagement of the projection and the engageable portion with each other and wherein the retention member is a pin placeable within the registered apertures.

3. A modular structural system as claimed in claim 1 wherein the engageable portion of the strut member is a slidingly engageable portion for sliding engagement with the projection of the connector hub member.

4. A modular structural system as claimed in claim 3 wherein the slidingly engageable portion of the strut member is an open jaw structure forming a channel.

5. A modular structural system comprising:

a) at least one connector hub member comprising a plurality of geometrically identical units bonded to each other to form a plurality of projections with adjacent protuberances arranged in a plurality of planes with each projection for engaging an end of a strut member, and with all respective projections with adjacent protuberances having identical cross sectional geometries;

b) at least one strut member having a first end and a second end, with each end comprising an engageable portion for engagement with a projection of the connector hub member, said strut member having a strut cross-sectional geometry identical to and in alignment with the cross-sectional geometry of a projection when the strut member is engaged with the projection; and c) a retention member for securing the end of the strut member with the projection of the connector hub member.

6. A modular structural system as claimed in claim 5 wherein each geometrical unit comprises a plurality of identical geometrical components bonded to each other to form the projection for engaging the end of one strut member.

7. A modular structural system as claimed in claim 6 wherein each geometrical unit has at least one surface area complimentary to at least one surface area of at least one other geometrical unit to thereby provide a bonding site for bonding respective units together.

8. A modular structural system as claimed in claim 7 wherein the surface areas are generally planar.

9. A modular structural system as claimed in claim 5 wherein each geometrical unit comprises a plurality of identical geometrical components bonded to each other to form the projection for engaging the end of one strut member.

10. A modular structural system as claimed in claim 5 wherein each projection of the connector hub member and each engageable portion of the strut member have apertures that register with each other upon engagement of the projection and the engageable portion with each other and wherein the retention member is a pin placeable within the registered apertures.

11. A modular structural system as claimed in claim 5 wherein the engageable portion of the strut member is a slidingly engageable portion for sliding engagement with the projection of the connector hub member.

12. A modular structural system as claimed in claim 11 wherein the slidingly engageable portion of the strut member is an open jaw structure forming a channel.

13. A modular structure comprising:

a) a plurality of connector hub members each comprising a plurality of projections with adjacent protuberances arranged in a plurality of planes with each projection for engaging an end of a strut member, and with all projections with adjacent protuberances having identical cross sectional geometries; and b) a plurality of strut members each having a first end and a second end, with each end comprising an engageable portion engaged with a projection of the connector hub member and secured thereto with a retention member, said strut members each having a strut cross-sectional geometry identical to and in alignment with the cross-sectional geometry of the adjacent protuberances and respective projection with which it is engaged.

14. A modular structure as claimed in claim 13 wherein each projection of the connector hub member and each engageable portion of the strut member have apertures that register with each other upon engagement of the projection and the engageable portion with each other and wherein the retention member is a pin placeable within the registered apertures.

15. A modular structure as claimed in claim 14 wherein the engageable portion of the strut member is a slidingly engageable portion for sliding engagement with the projection of the connector hub member.

16. A modular structure as claimed in claim 15 wherein the slidingly engageable portion of the strut member is an open jaw structure forming a channel.

17. A modular structure comprising:

a) a plurality of connector hub members each comprising a plurality of geometrically identical units bonded to each other to form a plurality of projections with adjacent protuberances arranged in a plurality of planes with each projection for engaging an end of a strut member, and with all respective projections with adjacent protuberances having identical cross sectional geometries; and b) a plurality of strut members each having a first end and a second end, with each end comprising an engageable portion engaged with a projection of the connector hub member and secured thereto with a retention member, said strut members each having a strut cross-sectional geometry identical to and in alignment with the cross-sectional geometry of adjacent protuberances of the respective projection with which it is engaged.

18. A modular structure as claimed in claim 17 wherein each geometrical unit comprises a plurality of identical geometrical components bonded to each other to form the adjacent protuberances and the projection for engaging the end of one strut member.

19. A modular structure as claimed in claim 18 wherein each geometrical unit has at least one surface area complimentary to at least one surface area of at least one other geometrical unit to thereby provide a bonding site for bonding respective units together.

20. A modular structure as claimed in claim 19 wherein the surface areas are generally planar.

21. A modular structure as claimed in claim 17 wherein each geometrical unit has at least one surface area complimentary to at least one surface area of at least one other geometrical unit to thereby provide a bonding site for bonding respective units together.

22. A modular structural system as claimed in claim 17 wherein each projection of the connector hub member and each engageable portion of the strut member have apertures that register with each other upon engagement of the projection and the engageable portion with each other and wherein the retention member is a pin placeable within the registered apertures.

23. A modular structural system as claimed in claim 17 wherein the engageable portion of the strut member is a slidingly engageable portion for sliding engagement with the projection of the connector hub member.

24. A modular structural system as claimed in claim 23 wherein the slidingly engageable portion of the strut member is an open jaw structure forming a channel.

* * * * *